US005598708A

United States Patent [19]

Clark

[11] Patent Number: 5,598,708

[45] Date of Patent: Feb. 4, 1997

[54] PHASE RESPONSIVE FLUID DELIVERY

[75] Inventor: John K. Clark, Kilsyth, Australia

[73] Assignee: LPG Engineering Pty Ltd., Kilsyth, Australia

[21] Appl. No.: 367,217

[22] PCT Filed: Aug. 9, 1993

[86] PCT No.: PCT/AU93/00402

§ 371 Date: Jan. 6, 1995

§ 102(e) Date: Jan. 6, 1995

[87] PCT Pub. No.: WO94/03755

PCT Pub. Date: Feb. 17, 1994

[30] Foreign Application Priority Data

Aug. 7, 1992 [AU] Australia ..... PL4025

[51] Int. Cl.[6] ..... F17C 13/02; F17C 7/02

[52] U.S. Cl. ..... 62/491; 62/50.1; 62/50.7

[58] Field of Search ..... 62/49.1, 49.2, 62/50.1, 50.7

[56] References Cited

U.S. PATENT DOCUMENTS

| | | | |
|---|---|---|---|
| 2,610,471 | 9/1952 | Thayer . | |
| 3,021,684 | 2/1962 | Berck . | |
| 3,933,030 | 1/1976 | Forster et al. | 62/49.1 |
| 4,062,223 | 12/1977 | Lamphere et al. | 62/49.1 |

FOREIGN PATENT DOCUMENTS

| | | |
|---|---|---|
| 3111589 | 3/1989 | Australia . |

*Primary Examiner*—Christopher Kilner
*Attorney, Agent, or Firm*—James P. Hanrath

[57] ABSTRACT

A system for delivering fluid, e.g. liquefied petroleum gas or "LPG", through a delivery path (10) under pressure. A delivery control valve (16) is selectably operable to close and open the delivery path (10) and monitors a parameter of the fluid, e.g. dielectric constant, and to sense the presence of vapor or gas phase in the fluid. A control means (30) responsive to the indicating signal from the sensing means (20) causes the delivery control valve (16) to close the delivery path upon sensing the presence of a significant proportion of vapor or gas phase in the fluid. A gas introduction point (35) upstream of the sensing means (20) enables gas to be introduced so as to knowingly expose the sensing means (20) to fluid containing gas phase and thereby enable controlled testing of the correct functioning of the sensing means (20). In the case of the fluid being liquefied gas, pumping means (45) upstream of the sensing means (20) can continue operation after closure of the delivery control valve (16) so that the gas or vapor phase will undergo compression and as a result will liquify and the control means (30) will then cause re-opening of the delivery control valve (16). The closure of the delivery control valve (16) prevents liquefied gas having a significant proportion of gas or vapor phase passing through a metering means (15) downstream of the sensing means (20).

9 Claims, 2 Drawing Sheets

PHASE RESPONSIVE FLUID DELIVERY

Figure 1:
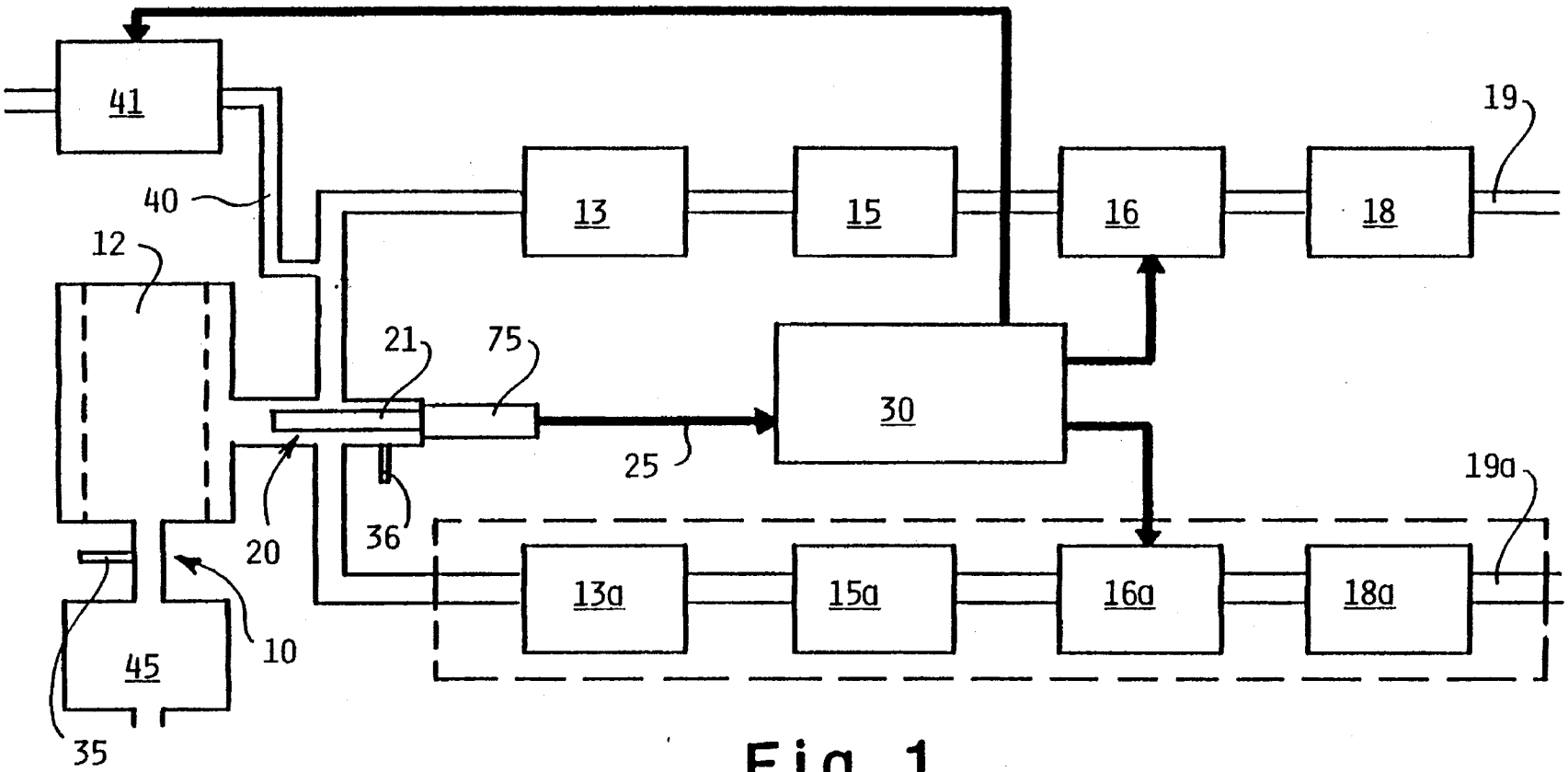

This invention relates to delivery of fluids and particularly, although not exclusively, to the delivery of liquefied gas such as liquefied petroleum gas ("LPG").

In currently known dispensing systems the dispensing of LPG from a supply tank involves passing a supply line from the tank to a vapour eliminator. The vapour eliminator comprises a vessel into which the LPG is introduced. The function of the vapour eliminator is to allow any LPG in vapour or gas phase which may have formed, e.g. in the supply line extending from the tank to the vapour eliminator, to rise to the top of the vapour eliminator vessel and to be returned to the main supply tank through a selectively operated valve. In one known system, the vapour return valve has been controlled by mechanical means, the particular arrangement being such that the presence of a vapour space in the top of the vapour eliminator vessel causes a float to open the vapour return valve. In another type of vapour eliminator, a constant bleed of liquid and any vapour that may be collecting at the top of the vapour eliminator vessel is returned to the main supply tank at all times. A sensitive differential valve associated with this bleed return line is used to sense when the vapour is being eliminated and to stop the metered dispensing of LPG from the vapour eliminator vessel.

In patent specification No. WO 91/14130 there is described and illustrated an LPG dispensing system in which there is provided a sensor in the top of the vapour eliminator vessel. This sensor senses the phase of the material within the vapour eliminator vessel by sensing the electrical properties, particularly the dielectric constant, of the material within the vessel. This system enables more accurate sensing of the presence of vapour or gas phase, even if a distinct and significant volume of vapour space does not develop above the liquid in the vessel. Also the system does not rely upon mechanical valves such as a float valve or sensitive differential valve since the detection of vapour or gas phase by electrical means enables solenoid valves to be used to achieve greater reliability and positive operation.

In the system disclosed in WO 91/14130, downstream of the vapour eliminator, the liquid phase LPG is passed through metering means and through delivery control valve means. Flow through the metering apparatus is most desirably prevented when there is vapour or gas phase present since such vapour or gas phase will introduce inaccuracies in the operation of the meter.

It is an object of the present invention to provide a fluid delivery system which is effective to control delivery of fluid and which enables control of the delivery in response to the changes in the phases or in the proportions of the gas and liquid phases in the fluid being delivered.

It is a further object to provide a fluid delivery system particularly suitable for controlling delivery of liquefied gas and for effectively controlling such delivery depending upon the phase or proportions of liquid and gas phase in the liquefied gas being delivered.

It is a further and preferred object of the present invention to provide a fluid delivery control system which can considerably simplify the control of liquified gas dispensing operations.

According to the present invention there is provided a fluid delivery system for delivering a fluid through a delivery path, the system in use being in communication with a source of the fluid, the fluid being delivered through the delivery path under pressure, the system including a delivery control valve associated with the delivery path and which is selectably operable to close and open the delivery path for controlling the delivery of fluid through the delivery path, the system being characterised by sensing means operatively associated with the delivery path so that in use the fluid passes the sensing means in travelling along the delivery path to the delivery control valve, the sensing means being operative to monitor a parameter of the fluid and to sense the presence of vapour or gas phase in the fluid passing the sensing means along the delivery path as indicated by a change in the parameter being monitored, the sensing means being operative to generate an indicating signal indicative of the phase of the fluid, the system further including a control means responsive to the indicating signal and operative to cause the delivery control valve to close the delivery path upon sensing the presence of a significant proportion of vapour or gas phase in the fluid passing the sensing means, and being further operative to re-open the delivery control valve when a significant proportion of vapour or gas phase is no longer sensed by the sensing means.

The sensing means may be operative to sense an electrical parameter of the fluid, e.g. the dielectric constant of the fluid. In this embodiment, the sensing means may comprise a sensitive element which is located directly in the flow of the fluid in the delivery path, the sensitive element having electrical characteristics which change in the presence of fluid having a significant proportion of gas or vapour phase at the sensitive element. The sensitive element may comprise a capacitive element arranged so that the fluid flowing through the delivery path flows through the capacitive element, the capacitance of the capacitive element changing upon the introduction of a significant proportion of gas or vapour phase in the fluid.

The system may include a gas introduction point in the delivery path at or upstream of the sensing means whereby gas phase can be introduced into the delivery path so as to knowingly expose the sensing means to fluid containing gas phase and thereby enable controlled testing of the correct functioning of the sensing means.

The system may also include a tapping line and an associated tapping control valve, the tapping line extending from the delivery path downstream of the sensing means and upstream of the delivery control valve, the tapping control valve being responsive to the sensing means so as to open the tapping line to enable fluid to be tapped from the delivery path for as long as the significant proportion of gas or vapour phase is being detected by the sensing means, the delivery control valve being maintained closed during the flow of fluid through the tapping line.

The system is particularly suitable for use in delivering liquefied gas (e.g. liquefied petroleum gas) from pumping means upstream of the sensing means, and the gas or vapour phase sensed by the sensing means being gas or vapour phase of the liquefied gas to be delivered. In this preferred system, the sensing means is operative to monitor the parameter of the liquefied gas, and the control means is responsive to the indicating signal indicating the presence of gas or vapour phase at the sensing means to cause closure of the delivery control valve, the pumping means being operative to continue operation after closure of the delivery control valve and thereby increase pressure of the liquefied gas upstream of the delivery control valve whereupon material in the gas or vapour phase will undergo compression and as a result will liquify and the indicating signal will indicate presence of substantially pure liquid phase at the sensing means and the control means will then cause re-opening of the delivery control valve.

In this preferred field of use, there may be provided metering means in the delivery path downstream of the sensing means and upstream of the delivery control valve, the closure of the delivery control valve in response to sensing of gas or vapour phase at the sensing means preventing liquefied gas having a significant proportion of gas or vapour phase passing through the metering means. The system may include a filter, the sensing means being located in the delivery path immediately downstream of the filter and upstream of the metering means.

By locating the sensing means in association with the delivery path so that the fluid passes the sensing means in travelling to the delivery control valve, it has been surprisingly discovered that it is possible to eliminate the vapour eliminator of the prior systems outlined earlier in the specification.

Figure 2:
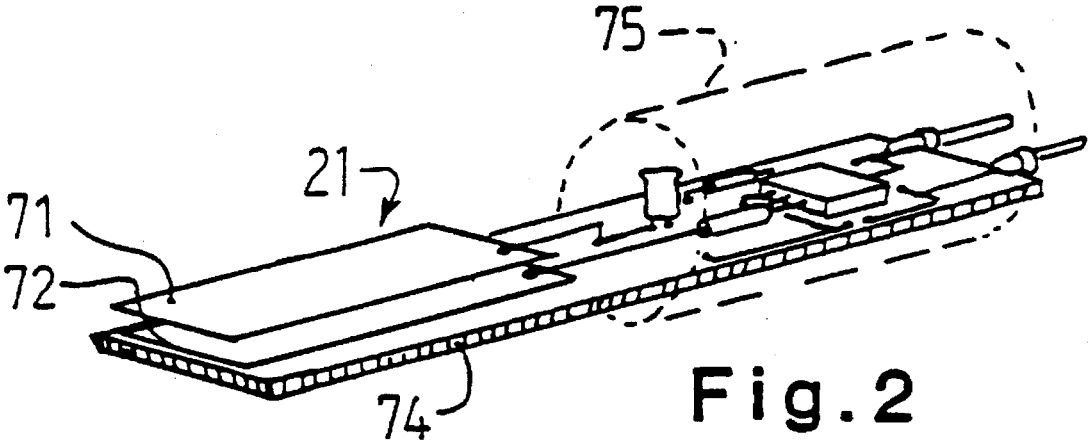

Possible and preferred features of the present invention will now be described with particular reference to the accompanying drawings. However it is to be understood that the features illustrated in and described with reference to the drawings are not to be construed as limiting on the scope of the invention. In the drawings:

FIG. 1 shows schematically a fluid delivery system according to one possible embodiment of the present invention, and FIG. 2 shows schematically a possible construction of sensing means.

The drawings illustrate a fluid delivery system particularly for dispensing of liquefied petroleum gas ("LPG") and it will be convenient to describe such a system in detail although the invention is not necessarily limited to such fluids. The LPG is supplied through an inlet line 11 from a supply tank (not shown) and pumping means 45. The LPG is supplied through a delivery path 10 comprising the inlet line 11, filter 12 for separating particulate impurities, non-return valve 13, a meter 15 for metering the amount of LPG passing therethrough, a delivery control valve 16 which is indicated as a solenoid valve, a stop valve 18, and then through delivery outlet 19. There may be additional components of an operational delivery or dispensing system, e.g. additional valve means downstream of the stop valve 18, as required by regulatory authorities. The meter 15 is constructed and operated so as to meter LPG in liquid phase and any presence of vapour or gas phase in the LPG flowing through the meter will introduce inaccuracies in the meter's operation.

At the outlet of the filter 12 there is provided a sensing means 20 arranged so that the LPG passing the sensing means can be monitored by the sensing means to detect the presence of any vapour or gas phase. In the preferred embodiment, the sensing means 20 is operative to sense a parameter of the LPG and preferably the parameter is an electrical parameter. In the preferred embodiment, the parameter is the dielectric constant. The sensing means 20 may comprise a sensitive element 21 which is located directly in the flow of LPG, the electrical characteristics of the sensitive element 21 changing upon introduction of any gas or vapour phase LPG at the sensitive element 21.

Preferably the sensitive element 21 comprises a capacitive element whose capacitance changes depending upon the presence of vapour or gas phase in the LPG. The capacitive element 21 may comprise two conductive plates 71, 72 as shown in FIG. 2, the plates 71, 72 being arranged generally parallel and spaced apart so that LPG in use passes between the plates. The plates 71, 72 are arranged in the LPG flow path so that the LPG flows between the plates and the capacitance of the sensitive element 21 thereby changes depending on the changes in dielectric properties of the LPG.

The sensitive element 21 may be connected in a sensing circuit 75 illustrated schematically in FIG. 2. The electrical components of the sensing circuit 75 are mounted on a circuit board 74 which also supports the conductive plate 72. A possible circuit arrangement for the sensing circuit 75 is described and illustrated in patent specification WO 91/14130, particularly in relation to FIG. 3 of that specification and the contents of that specification are incorporated herein by cross reference.

The output of the sensing means 20 comprises an indicating signal on output line 25, the indicating signal being indicative of the phase of the LPG at the sensitive element 21. The indicating signal on line 25 is supplied to control means 30 indicated in FIG. 1 as a central processing unit, such as a programmed microprocessor. The control means 30 receives the indicating signal and is operative upon receipt of the indicating signal indicating presence of vapour or gas phase in the LPG at the sensitive element 21 to cause the closure of the delivery control valve 16.

In operation of the system illustrated in FIG. 1 and outlined above, the detection of the presence of gas or vapour phase in the LPG at the sensing means 20 will cause closure of the delivery path 10 by closure of the delivery control valve 16. In this circumstance, with the continued operation of the pump 45 upstream of the inlet line 11, the LPG within the delivery path upstream of the delivery control valve 16 will be compressed and as a result the vapour or gas phase LPG will liquefy. The sensing by the sensing means 20 of substantially purely liquid phase material will then cause the control means 30 to open the delivery control valve 16 for commencement or recommencement of delivery of the LPG. Thus it will be seen that liquid phase material can be exclusively delivered and the operation of the metering means 15 remains accurate.

The system in FIG. 1 also includes duplicated components 13*a*, 15*a*, 16*a*, 18*a*, 19*a* downstream of the sensing means 20 so that LPG can pass through the filter 12 and past the sensing means 20 and then flow through either or both delivery paths. Thus the system can be used in dual dispensers, e.g. of the kind provided at automotive fuel supply outlets.

In addition to the elimination of the vapour eliminator vessel used in the prior systems outlined above, it will be seen that the system described above and illustrated in the drawings also eliminates the vapour return line from the prior vapour eliminator vessel to the main supply tank. Elimination of this return line simplifies and makes safer the circuit arrangement and simplifies installation and maintenance.

A further advantage over the prior systems arises from the ability to adequately test the system for proper functioning, not only before the system by the manufacturer but also after installation. A problem with the prior vapour eliminator vessels is that the testing for proper functioning within the manufacturing factory has been difficult and, after installation on site, the vapour eliminator vessel and its associated valves and return line have not been capable of being effectively and readily tested for proper functioning. In the case of the system according to the present invention illustrated in the drawings, the proper functioning of the vapour sensing means and control means can be readily and accurately tested by deliberately introducing gas phase material in the inlet line, e.g. at the point 35. By introducing, for example, an inert gas such as nitrogen at this point 35, the detection of the presence of gas bubbles in the LPG by the sensing means 20 can be checked. In this test procedure, closing of the delivery control valve 16 and continued operation of the pump 45 upstream of the inlet 11 will not cause an inert gas such as nitrogen to be liquefied or dissolved in the LPG so that the control means 30 should continue to hold the delivery control valve 16 closed. By bleeding off LPG with the entrained inert gas bubbles through tapping 36, the correct desired operation of the sensing means 20 upon substantially pure liquid phase reaching the sensitive element 21 can be verified, and the control means 30 can be tested in its desired operation of reopening the delivery control valve 16.

Thus the delivery system according to the preferred embodiment of the present invention described and illustrated enables the testing of correct and accurate operation of the system in preventing flow of vapour or gas phase through the meter 13.

Instead of allowing the pump 45 to liquefy the vapour phase, it is also possible to provide a selectively open tapping line 40 which may return fluid to the source or may vent the fluid containing gas or vapour phase to atmosphere. The line 40 is located immediately downstream of the sensing means 20 and before the non return valves 13. In operation, the control means 30 may close the delivery control valve 16 and simultaneously open a tapping control valve 41 so that fluid containing vapour or gas phase as sensed at the sensitive element 21 can be directed through line 40, e.g. back to the main supply tank, until pure liquid phase is sensed. Although this variation involves additional fluid line 40, valve 41 and additional functions and wiring from the control means 30, the facility for vapour return or venting may be useful and acceptable in some fluid dispensing or delivery systems, such as for fluids other than LPG. The advantage of stopping delivery so as to reduce or eliminate inaccuracies in metering due to presence of vapour gas phase is still achieved if the fluid containing vapour or gas phase is vented or returned upstream of the meter 15.

I claim:

1. A fluid delivery system for delivering a fluid through a delivery path (10), the system in use being in communication with a source of the fluid, the fluid being delivered through the delivery path (10) under pressure, the system including a delivery control valve (16) associated with the delivery path and which is selectably operable to close and open the delivery path (10) for controlling the delivery of fluid through the delivery path, the system being characterised by sensing means (20) operatively associated with the delivery path so that, when the delivery control valve is open and the fluid is flowing through the delivery path the fluid passes the sensing means (20) in immediate proximity thereto in travelling along the delivery path (10) to the delivery control valve (16), the sensing means being operative to monitor a dielectric property of the flowing fluid and to sense the presence of vapour or gas phase in the flowing fluid passing the sensing means (20) along the delivery path as indicated by a change in the dielectric property being monitored, the sensing means (20) being operative to generate an indicating signal indicative of the phase of the fluid, the system further including a control means (30) responsive to the indicating signal and operative to cause the delivery control valve (16) to close the delivery path upon sensing the presence of a significant proportion of vapour or gas phase in the fluid passing the sensing means (20), and being further operative to re-open the delivery control valve (16) when a significant proportion of vapour or gas phase is no longer sensed by the sensing means (20).

2. A system as claimed in claim 1 characterised in that the dielectric property comprises the dielectric constant of the fluid.

3. A system as claimed in claim 1 characterised in that the sensing means (20) comprises a sensitive element (21) which is located directly in the flow of fluid in the delivery path (10), the sensitive element having electrical characteristics which change in the presence of fluid having a significant proportion of gas or vapour phase at the sensitive element (21).

4. A system as claimed in claim 3 characterised in that the sensitive element (21) comprises a capacitive element (71, 72) arranged so that the fluid flowing through the delivery path (10) flows through the capacitive element, the capacitance of the capacitive element (71, 72) changing upon the introduction of a significant proportion of gas or vapour phase in the fluid.

5. A system as claimed in claim 1 characterised in that there is provided a gas introduction point (35) in the delivery path (10) at or upstream of the sensing means (20) whereby gas phase can be introduced into the delivery path so as to knowingly expose the sensing means (20) to fluid containing gas phase and thereby enable controlled testing of the correct functioning of the sensing means (20).

6. A system as claimed in claim 1 characterised in that there is further provided a tapping line (40) and an associated tapping control valve (41), the tapping line (40) extending from the delivery path (10) downstream of the sensing means (20) and upstream of the delivery control valve (16), the tapping control valve (41) being responsive to the sensing means (20) so as to open the tapping line (40) to enable fluid to be tapped from the delivery path (10) for as long as the significant proportion of gas or vapour phase is being detected by the sensing means (20), the delivery control valve (16) being maintained closed during the flow of fluid through the tapping line (40).

7. A system as claimed in claim 1 the fluid being liquefied gas, the system including pumping means (45) upstream of the sensing means (20), the gas or vapour phase sensed by the sensing means (20) being gas or vapour phase of the liquefied gas to be delivered, the system being characterised in that the sensing means (20) is operative to monitor the dielectric property of the liquefied gas, and the control means (30) is responsive to the indicating signal indicating the presence of gas or vapour phase at the sensing means (20) to cause closure of the delivery control valve (16), the pumping means (45) being operative to continue operation after closure of the delivery control valve (16) and thereby increase pressure of the liquefied gas upstream of the delivery control valve (16) whereupon material in the gas or vapour phase will undergo compression and as a result will liquefy and the indicating signal will indicate presence of substantially pure liquid phase at the sensing means (20) and the control means (30) will then cause re-opening of the delivery control valve (16).

8. A system as claimed in claim 7 characterised in that there is provided metering means (15) in the delivery path (10) downstream of the sensing means (20) and upstream of the delivery control valve (16), the closure of the delivery control valve (16) in response to sensing of gas or vapour phase at the sensing means (20) preventing liquefied gas having a significant proportion of gas or vapour phase passing through the metering means (15).

9. A system as claimed in claim 8 characterised in that the system includes a filter (12), the sensing means (20) being located in the delivery path (10) immediately downstream of the filter (12) and upstream of the metering means (15).

* * * * *